United States Patent [19]

Grossman

[11] 4,379,432

[45] Apr. 12, 1983

[54] ARTICLE DISPLAY STAND

[76] Inventor: Robert D. Grossman, 22 Rivo Alto Dr., Miami Beach, Fla. 33139

[21] Appl. No.: 175,783

[22] Filed: Aug. 6, 1980

[51] Int. Cl.[3] ..... A47B 3/06

[52] U.S. Cl. ..... 108/153; 108/159; 211/189; 248/165; 248/174

[58] Field of Search ..... 211/189, 135; 108/153, 108/159; 206/423; 220/22; 248/174, 165; 47/39; 261/DIG. 14; 46/30, 31

[56] References Cited

U.S. PATENT DOCUMENTS

| | | | |
|---|---|---|---|
| 1,103,286 | 7/1914 | Hallett | 248/174 |
| 3,069,216 | 12/1962 | Vaeth | 108/153 X |
| 3,566,808 | 3/1971 | Slate, Jr. | 108/153 |
| 3,567,300 | 3/1971 | Mari | 108/153 X |
| 3,692,190 | 9/1972 | Dolas | 248/174 |
| 3,931,894 | 1/1976 | Murphy | 211/189 |
| 4,025,012 | 5/1977 | Chan et al. | 47/39 |
| 4,179,033 | 12/1979 | Mitchell | 211/189 X |

*Primary Examiner*—James T. McCall

*Attorney, Agent, or Firm*—Leitner, Palan, Martin & Bernstein

[57] ABSTRACT

An article display stand is formed of one pair of identical semicylindrical vertical support members and one pair of identical horizontal support members. The horizontal support members have means thereon to hold the vertical support members in position. The vertical support members are preferably formed of transparent material to permit viewing therethrough.

8 Claims, 3 Drawing Figures

FIG. 1
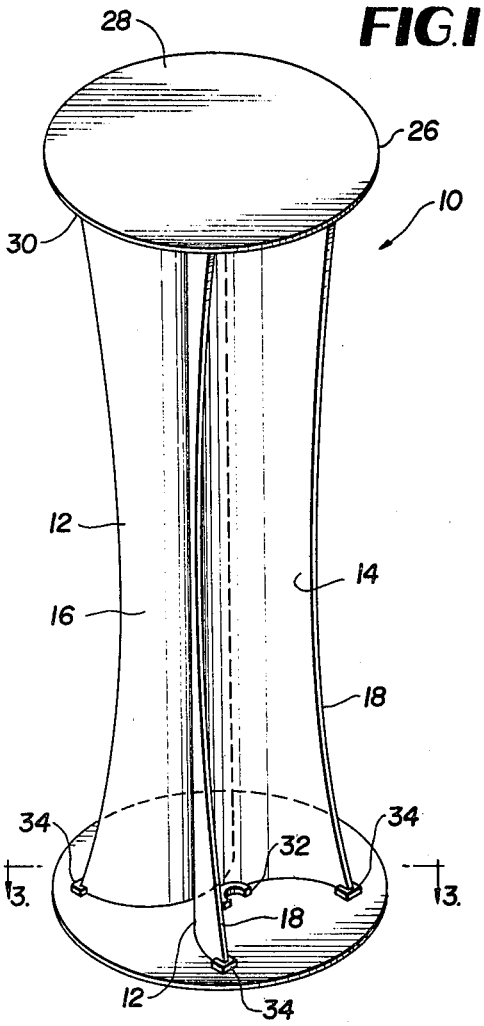
FIG. 2
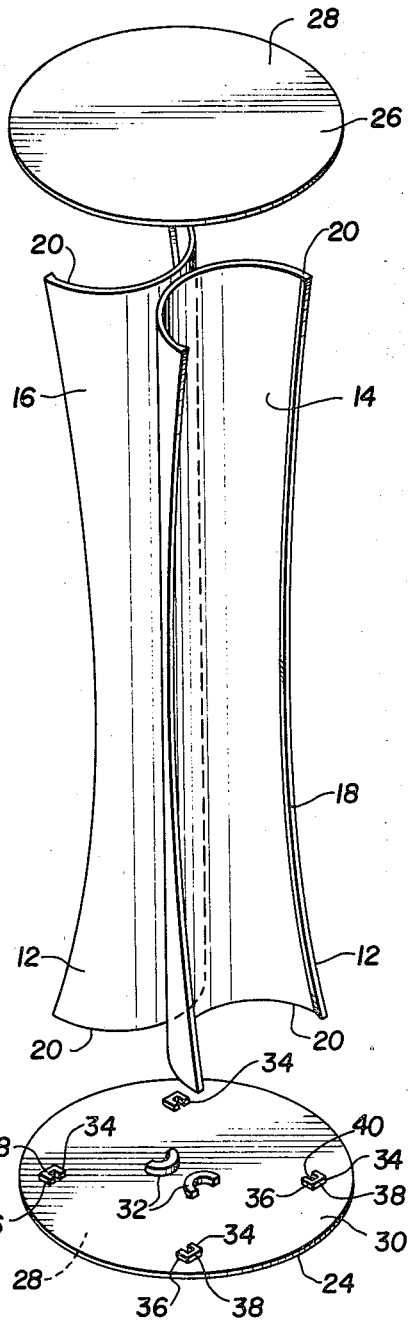
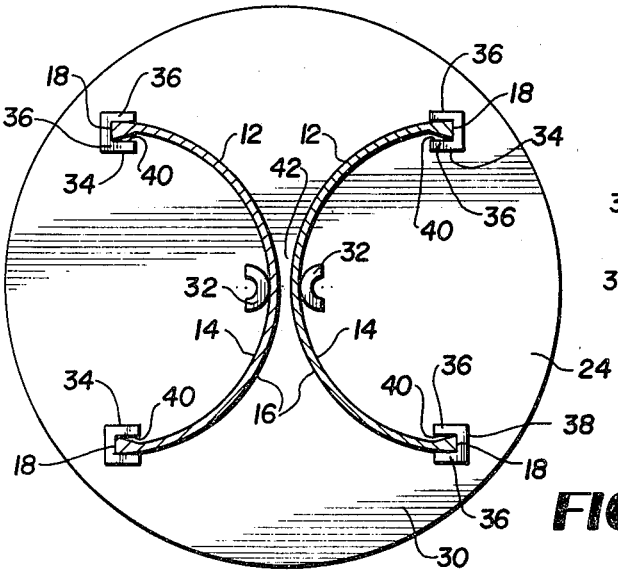
FIG. 3

ARTICLE DISPLAY STAND

BACKGROUND OF THE INVENTION

This invention relates to an article display stand and particularly to a stand that can be easily assembled and disassembled for ease of storage.

The display of articles for sale in a retail establishment such as a florist or a jewelry store is an important part of proper merchandising. Also, the use of appropriate display stands for floral centerpieces is an important factor in contributing to the overall aesthetics of social events such as banquets, weddings, etc. In both of the above-mentioned uses, it is advantageous to have display stands that can be easily assembled or disassembled so that each display stand requires only a minimum of storage space. This is particularly important for florists that may have need for a multitude of centerpiece stands.

Additionally, with respect to centerpiece stands, it is preferable that the stand be made of a transparent material to permit persons on opposite sides of a banquet table to view each other. As generally in use at the present time, centerpiece floral arrangements are placed in the table center causing great difficulty for persons on opposite sides to see and converse with each other.

There is thus a need for a knockdown type of article display stand that can be formed of transparent plastic material and that can provide a stable, solid and firm support for an article.

OBJECTS OF THE INVENTION

It is an object of the invention to provide an article display stand that can be readily assembled and disassembled.

It is another object of the invention to provide an article display stand that has a pleasing appearance and is made of transparent plastic material.

It is still another object of the invention to provide an article display stand that can be molded of plastic material with use of only two different molds.

It is still a further object of the invention to provide an article display stand that requires four molded parts and that can be assembled and disassembled without any fasteners.

SUMMARY OF THE INVENTION

The above outlined objectives as well as other objects and features of the present invention are accomplished by an article display stand formed of one pair of identical vertical support members and one pair of identical horizontal support members. The horizontal support members have means thereon to hold the vertical support members in position. The vertical support members are preferably formed of transparent material to permit viewing therethrough and may also include a coloring material to vary the overall aesthetic effect of the article display stand.

BRIEF DESCRIPTION OF THE DRAWINGS

For a full understanding of the nature and objects of the invention, reference should be had to the following detailed description taken in conjunction with the accompanying drawings in which:

FIG. 1 is a perspective view showing the article display stand in accordance with the present invention;

FIG. 2 is an exploded view of the article display stand showing the parts in unassembled condition; and FIG. 3 is a sectional view taken along the line 3—3 of FIG. 1 looking in the direction of the arrows.

DESCRIPTION OF THE PREFERRED EMBODIMENT

Referring now to the drawings in detail, wherein like reference numerals indicate like parts throughout the several figures, reference numeral 10 indicates the article display stand of the present invention. The article display stand 10 comprises just two types of components with two of each type used to assemble the stand.

The first type of component utilized in the stand 10 is the vertical support member 12 generally formed in a semicylindrical shape having an inner concave surface 14, an outer convex surface 16, side edges 18, 18 and top and bottom edges 20, 20. The side edges are preferably formed in a slight concave configuration to enhance the overall aesthetic effect of the stand 10.

As seen best in FIG. 3, the side edges 18, 18 are preferably formed of greater thickness then the major portion of the semicylindrical vertical support member 12 to enhance the strength of the side edges in securing the vertical support members to the second component used in the article display stand 10.

The vertical support members 12 are preferably molded of a polycarbonate thermoplastic material such as LEXAN. The polycarbonate thermoplastic material is preferably molded in a transparent form although a coloring material may be used to vary the overall look of the stand. Other equivalent polycarbonates may be used so long as they provide good dimensional stability and high impact strength as LEXAN polycarbonate.

The second component is the horizontal support member 22 with one member being used as a lower end 24 and a second member being used as an upper end 26. Each support member 22 includes a flat planar outer surface 28 and an inner surface 30 formed with spacer elements 32 and retainer elements 34 to position and support the vertical support members 12. Both the spacer elements 32 and the retainer elements 34 are preferably integrally molded with the inner surface 30 although the elements 32 and 34 could be separately formed and then joined to the inner surface 30 by the use of a suitable fastening means such as adhesive. It is preferred, however, that the horizontal support member 22 be molded in one piece of the same type of plastic material used for the vertical support members 12 although the horizontal support members will generally be opaque. As shown, the horizontal support members 22 are circular in shape although other shapes may be used to vary the design appearance.

The spacer elements 32 are preferably C-shaped although other shapes may be utilized to perform the same function, namely, to provide a curved segment against which the concave surface 14 of the vertical support member 12 can be placed to restrain movement of the vertical support member when a load is placed thereon. To attach the vertical support member 12 to the horizontal support member 22, the retainer elements 34 are provided in a U-shaped configuration having leg sections 36 and a bight section 38. An opening 40 is formed between leg sections 36 with the width of the opening 40 between leg sections 36 being slightly smaller than the thickness of the side edges 18 to thus provide a tight friction grasp of the vertical support members. As been best in FIG. 3, the spacer elements 32 and the retainer elements 34 are positioned on the inner surface 30 so that a space 42 is formed between the two vertical support members 12 when in position. This space not only permits a more rapid assembly of parts but the space adds to the aesthetic look of the assembled stand 10.

The parts are preferably shipped to the user in unassembled condition with a horizontal support member 12 placed within the concave portion of an adjacent member in stacked fashion so that only a small container need be used to ship a large number of stands 10. Assembly of an article display stand 10 is fairly obvious from the preceeding description. One of the horizontal support members 22 is selected and placed on a planar surface with the inner surface 30 facing upwardly. A first vertical support member 12 is placed about the spacer element 32 and the side edges 18 are press fitted into the openings 40 of two of the retainer elements 34 until the bottom edge 20 lies against the inner surface 30. In similar fashion, a second vertical support member 12 is attached thereto and a second horizontal support member is then placed in position on top of the vertical support members 12 and the side edges 18 are press fitted into the retainer elements 34 until the top edges 20 of the vertical support members 12 lie against the inner surface 30 of the horizontal support member. The large amount of bearing surface between the vertical support members and the horizontal support members insures that the assembled stand 10 is extremely stable and strong.

There has thus been provided an article display stand that can be quickly assembled and disassembled using just two different types of molded parts and which efficiently attains the objects set forth above. Since certain changes may be made in the above construction without departing from the scope of the invention, it is intended that all matters contained in the above description or as shown in the accompanying drawings shall be interpreted as illustrative and not in a limiting sense.

What is claimed is:

1. An article display stand including a pair of substantially identical vertical support members and a pair of substantially identical horizontal support members, each of said horizontal support members including retaining means on one side thereof to hold said vertical support members in position between said horizontal support members, each of said vertical support members is an integral molded element having a pair of longitudinal side edges, and said retaining means comprises four separate elements adapted to hold a portion of said side edges and each of said retaining means elements comprises a pair of leg members connected by a bight portion and said portion of said side edges is frictionally held between said leg members.

2. An article display stand comprising:

a pair of substantially identical vertical support members, each vertical support member having a pair of longitudinal side edges and a concave surface connecting said longitudinal side edges; and a pair of substantially identical horizontal support members, each horizontal support member having an inner surface with four separate retaining elements on said inner surface and extending therefrom, each of said retaining elements being adapted to engage one of said longitudinal side edges and a portion of said concave surface so as to frictionally hold said vertical support members in position between said horizontal support members.

3. The article display stand of claim 2 wherein each of said retaining elements comprises a pair of leg members connected by a bight portion, wherein said longitudinal side edges and a portion of said concave surface are frictionally held between said leg members.

4. The article display stand of claim 2 further including spacer means adapted to abut against said concave surface of each of said vertical support members for restaining movement of said vertical support members when a load is placed on said horizontal support members.

5. An article display stand comprising:

a pair of substantially identical vertical support members having an inner concave surface, an outer surface and a pair of longitudinal side edges;

a pair of substantially identical horizontal support members, each of said horizontal support members including:

retaining means on one side thereof, adapted to hold said vertical support members in a generally vertical position between said horizontal support members by means of separate retaining means elements adapted to hold a portion of said side edges of said vertical support members; and spacer means on the same side of said horizontal support member as said retaining means and spaced apart and distinct from said retaining means, for abutting against said inner surface of said vertical support members and restraining movement of said vertical support members in cooperation with said retaining means when a load is placed on said horizontal support members.

6. The article display stand of claim 5 wherein each of said retaining means comprises a pair of leg members connected by a bight portion and said portion of said side edges of each vertical support is frictionally held between said leg members.

7. The article display stand of claim 1, wherein each of said vertical support members is of semicylindrical shape and said horizontal support members include spacer means adapted to abut against the concave surface of each of said vertical support members.

8. The article display stand of claim 7, wherein said vertical support members are formed from transparent thermoplastic material.

* * * * *